US006768046B2

(12) United States Patent
Kriechbaum et al.

(10) Patent No.: US 6,768,046 B2
(45) Date of Patent: Jul. 27, 2004

(54) METHOD OF GENERATING A LINK BETWEEN A NOTE OF A DIGITAL SCORE AND A REALIZATION OF THE SCORE

(75) Inventors: Werner Kriechbaum, Ammerbuch-Breitenholz (DE); Gerhard Stenzel, Herrenberg (DE)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/295,058

(22) Filed: Nov. 14, 2002

(65) Prior Publication Data

US 2003/0188626 A1 Oct. 9, 2003

(30) Foreign Application Priority Data

Apr. 9, 2002 (EP) ..... 02007897

(51) Int. Cl.[7] ..... A63H 5/00; G04B 13/00; G10H 7/00

(52) U.S. Cl. ..... 84/609; 84/615; 84/649; 84/653; 84/477 R

(58) Field of Search ..... 84/600, 609–611, 84/615–616, 618, 622–625, 649–651, 653–654, 656, 659–661, 477 R

(56) References Cited

U.S. PATENT DOCUMENTS 4,744,281 A 5/1988 Isozaki
5,046,004 A 9/1991 Tsumura et al.
5,083,491 A 1/1992 Fields
5,142,961 A 9/1992 Paroutaud
5,153,829 A 10/1992 Furuya et al.
5,208,421 A 5/1993 Lisle et al.
5,247,126 A 9/1993 Okamura et al.
5,262,940 A 11/1993 Sussman
5,317,732 A 5/1994 Gerlach, Jr. et al.
5,388,264 A 2/1995 Tobias, II et al.
5,390,138 A 2/1995 Milne et al.
5,393,926 A 2/1995 Johnson
5,405,153 A * 4/1995 Hauck ..... 273/460
5,463,698 A 10/1995 Meyer
5,663,517 A * 9/1997 Oppenheim ..... 84/649
6,199,076 B1 3/2001 Logan et al.
6,297,439 B1 * 10/2001 Browne ..... 84/635
6,372,973 B1 * 4/2002 Schneider ..... 84/609

* cited by examiner

*Primary Examiner*—Marlon Fletcher
(74) *Attorney, Agent, or Firm*—Volel Emile; Leslie Van Leeuwen

(57) ABSTRACT

A system and method of generating a link between a note of a digital score and a realization of the score are provided. To do so, a digital score is processed to generate an onset curve. The onset curve is then filtered to generate a first series of first time intervals, which each have a significant number of onsets. A realization of the digital score is also processed to generate a second series of second time intervals, which each have a significant dynamic change of the realization. The first and the second series of time intervals are then correlated to produce the link.

27 Claims, 4 Drawing Sheets

METHOD OF GENERATING A LINK BETWEEN A NOTE OF A DIGITAL SCORE AND A REALIZATION OF THE SCORE

FIELD OF THE INVENTION

The present invention relates to the field of digital representation of music and to techniques for allowing a user to enter a selection of a realization of the music.

BACKGROUND AND PRIOR ART

Most of today's audio data, at the professional as well as at the consumer level, is distributed and stored in digital format. This has greatly improved the general handling of recorded audio material, such as transmission of audio files and modification of audio files.

Techniques for navigating among audio data files have been developed. For example a track number and time is used as a navigation means for compact discs (CDs). A variety of more sophisticated techniques for navigating among the program segments and to otherwise process audio files is known from the prior art:

U.S. Pat. No. 6,199,076 shows an audio program player including a dynamic program selection controller. This includes a playback unit at the subscriber location to reproduce the program segments received from a host and a mechanism for interactively navigating among the program segments.

U.S. Pat. No. 5,393,926, is a virtual music system. There is included a multi-element actuator that generates a plurality of signals in response to being played by a user. The system also has an audio synthesizer that generates audio tones in response to control signals. There is a memory storing a musical score for the multi-element actuator, the stored musical score including a sequence of lead notes and an associated sequence of harmony note arrays. Each harmony note array of the sequence corresponding to a different one of the lead notes and contain zero, one or more harmony notes. The instrument also includes a digital processor receiving the plurality of signals from the multi-element actuator and generating a first set of control signals therefrom. The digital processor is programmed to identify from among the sequence of lead notes in the stored musical score a lead note which corresponds to a first one of the plurality of signals. The digital processor is also programmed to map a set of the remainder of the plurality of signals to whatever harmony notes are associated with the selected lead note, if any. Moreover, the digital processor is programmed to produce the first set of control signals from the identified lead note and the harmony notes to which the signals of the plurality of signals are mapped. The first set of control signals causes the synthesizer to generate sounds representing the identified lead note and the mapped harmony notes.

U.S. Pat. No. 5,390,138, is a system for connecting an audio object to various multimedia objects to enable an object-oriented simulation of a multimedia presentation using a computer with a storage and a display. A plurality of multimedia objects are created on the display including at least one connection object and at least one audio object. Multimedia objects are displayed, including at least one audio object. The multimedia object and the audio object create a multimedia presentation.

U.S. Pat. No. 5,388,264, is a system for connecting a Musical Instrument Digital Interface (MIDI) object to various multimedia objects to enable an object-oriented simulation of a multimedia presentation using a computer with a storage and a display. A plurality of multimedia objects are created on the display including at least one connection object and at least one MIDI object in the storage. The multimedia object and the MIDI object are connected, and information is routed there between to create a multimedia presentation.

U.S. Pat. No. 5,317,732 is a process performed in a data processing system that includes receiving an input selecting one of a plurality of multimedia presentations to be relocated from a first memory to a second memory, scanning the linked data structures of the selected multimedia presentation to recognize a plurality of resources corresponding to the selected multimedia presentation, and generating a list of names and locations within the selected multimedia presentation corresponding to the identified plurality of resources. The process also includes renaming the names on the generated list, changing the names of the identified plurality of resources in the selected multimedia presentation to the new names on the generated list, and moving the selected multimedia presentation and the resources identified on the generated list to the second memory.

U.S. Pat. No. 5,262,940 is a portable audio/audio-visual media tracking device.

U.S. Pat. No. 5,247,126, is an image reproducing apparatus, image information recording medium, and musical accompaniment playing apparatus.

U.S. Pat. No. 5,208,421, is a method and apparatus for audio editing of MIDI files. The invention may be utilized to ensure the integrity of a source MIDI file, a copied or lifted section or a target file by automatically inserting matching note on or note off messages into a file or file section to correct inconsistencies created by such editing. Additionally, program status messages are automatically inserted into source files, copied or lifted sections, or target files to yield results that are consistent with the results that may be obtained by editing digital audio data. Timing information is selectively added or maintained such that MIDI files may be selectively edited without requiring a user to learn a complex MIDI sequencer.

U.S. Pat. No. 5,153,829, is an information processing apparatus. The invention has a unit for displaying on a screen a musical score, keyboard, and tone time information to be inputted. There is also a unit for designating the position of the keyboard, and tone time information, respectively displayed on the display unit. Moreover, the invention includes a unit for storing musical information produced through designation by the designating unit of the position of the keyboard and tone time information displayed on the display unit. Additionally, there is a unit for controlling the display of the musical score, keyboard, and tone time information on the screen of the display unit. The unit also is for controlling the display of a pattern of musical tone or rest on the musical score on the display unit in accordance with the position of the keyboard and tome time information respectively designated by the designating unit. Finally, there is a unit for generating a musical tone by reading the musical information stored in the storage unit.

U.S. Pat. No. 5,142,961, is a method for storage, transcription, manipulation and reproduction of music on system-controlled musical instruments which faithfully reproduces the characteristics of acoustic musical instruments. The system comprises a music source, a central processing unit (CPU) and a CPU-controlled plurality of instrument transducers in the form of any number of acoustic or acoustic hybrid instruments. In one embodiment, performance information is sent from a music source MIDI controller to the CPU, edited in the CPU, converted into an electrical signal, and sent to instrument transducers via transducer drivers. In another embodiment, individual performances stored in a digital or sound tape medium are reproduced at will through the instrument transducers, or converted into MIDI data by a pitch/frequency detection device for storage, editing or performance in the CPU. In still another embodiment, performance information is extracted from an electronic recording medium or live performance by a pitch/frequency detection device, edited in the CPU, converted into an electrical signal, and sent to any number of instrument transducers. The device also eliminates typical acoustic musical instrument delay problems.

U.S. Pat. No. 5,083,491, is a method and apparatus for re-creating expression effects on solenoid actuated music producing instruments contained in musical renditions recorded in MIDI format for reproduction on solenoid actuated player piano systems. Detected strike velocity information contained in the MIDI recording is decoded and correlated to strike maps stored in a controlling microprocessor. The strike maps contain data corresponding to desired musical expression effects. Time differentiated pulses of fixed width and amplitude are directed to the actuating solenoids in accordance with the data in the strike maps, and the actuating solenoids in turn strike the piano strings. Thereafter, pulses of uniform amplitude and frequency are directed to the actuating solenoids to sustain the strike until the end of the musical note. The strike maps dynamically control the position of the solenoid during the entire duration of the strike to compensate for non-linear characteristics of solenoid operation and piano key movement, thus providing true reproduction of the original musical performance.

U.S. Pat. No. 5,046,004 is a system using a computer and keyboard for reproducing music and displaying words to the music. Data for reproducing music and displaying words are composed of binary-coded digital signals. Such signals are downloaded via a public communication line, or data corresponding to a plurality of musical pieces or songs are previously stored in an apparatus, and the stored data are selectively processed by a central processing unit of a computer. In the instrumental music data, trigger signals are existent for progression of processing the words data, whereby the reproduction of music and the display of words are linked to each other. The music thus reproduced is utilized as background music or for enabling the user to sing to the accompaniment thereof while watching the words displayed synchronously with such music reproduction.

U.S. Pat. No. 4,744,281, is an automatic music player system having an ensemble playback mode of operation using a memory disk having recorded thereon a piece of music composed of at least two combined parts to be reproduced separately of each other. The parts being recorded in the form of at least two data subblocks, comprising a first sound generator to mechanically generate sounds when mechanically or electrically actuated, at least one second sound generator to electronically generate sounds when electronically actuated and a control unit connected to the first and second sound generators. One of the two or more subblocks of the data read from the disk is discriminated from another, whereupon the discriminated one of the data subblocks is transmitted to the first sound generator and another data subblock transmitted to the second sound generator. Additionally, the transmission of data to the second sound generator is continuously delayed by a predetermined period of time from the transmission of data to the first sound generator so that the two sound generators are enabled to produce sounds concurrently and in concert with each other.

It is a common disadvantage of the prior art that navigating among audio data is cumbersome and seriously lacks precision.

SUMMARY OF THE INVENTION

Accordingly it is an aspect of the present invention to provide an improved method of generating a link between a note of a digital score and a realization of the score as well as a corresponding computer program product. Further the invention provides an electronic audio device with improved navigation capabilities.

The invention enables to create a link between a representation of a piece of music and a recorded realization of the music. This allows to select a note of a digital score in order to automatically begin a playback of the realization starting with the selected note.

In accordance with a preferred embodiment of the invention the digital score is visualized on a computer monitor. By means of a graphical user interface a user can select a note of the digital score. For example, this can be done by "clicking" on a note by means of a computer mouse. This way a link which is associated with the note is selected. The link points to a location of a recorded realization of the music which corresponds to the user selected note. Further a signal is generated automatically by selecting the note which starts playback of the realization at the location indicated by the link which is associated with the selected note.

In accordance with a further preferred embodiment of the invention the digital score is analyzed to determine significant audio events in the music. This is done by selecting a time unit that allows to express all notes of the score as integer multiples of this time unit. This way the time axis is divided into logical time intervals.

The number of onsets of the score in each of the time intervals is determined. This results in the number of onsets over time. This onset curve is filtered. One way of filtering the onset curve is to apply a threshold to the onset curve. This means that the accumulated onsets of time intervals which do not surpass the predefined threshold are removed from the onset curve. This way insignificant audio events are filtered out.

The filtered onset curve determines a series of time intervals with accumulated onsets above the threshold. This series of time intervals is to be aligned with a corresponding series of time intervals being representative of the same audio events in the recorded realization of the music.

In accordance with a preferred embodiment of the invention the series of time intervals for the recorded realization is determined by comparing the intensity of the realization with a threshold. When the intensity drops below the threshold the corresponding time interval is selected for the series of time intervals.

In accordance with a further preferred embodiment of the invention the mapping of the series of time intervals of the representation and of the realization are mapped by means of minimizing a Hausdorff distance between the two series.

Felix Hausdorff (1868–1942) devised a metric function between subsets of a metric space. By definition, two sets are within Hausdorff distance d from each other if any point of one set is within distance d from some point of the other set.

Given two sets of points $A=\{a_1, \ldots, a_m\}$ and $B=(b_1, \ldots, b_n)$: the Hausdorff distance is defined as $$H(A, B)=\max(h(A, B), h(B, A)) \quad (1)$$

where $$h(A, B) = \max_{a\in A} \min_{b\in B} \|a - b\|. \quad (2)$$

The function h(A, B) is called the directed Hausdorff 'distance' from A to B (this function is not symmetric and thus is not a true distance). It identifies the point $a\epsilon A$ that is farthest from any point of B, and measures the distance from a to its nearest neighbor in B. Thus the Hausdorff distance, H(A, B), measures the degree of mismatch between two sets, as it reflects the distance of the point of A that is farthest from any point of B and vice versa. Intuitively, if the Hausdorff distance is d, then every point of A must be within a distance d of some point of B and vice versa.

The two series of time intervals provided by the analysis of the score and the analysis of the realization are shifted with respect to each other until the Hausdorff distance between the two sets of time intervals reaches a minimum. This way pairs of time intervals of the two series are determined. Hence, for each pair a note belonging to a specific time interval is mapped onto a point of time of a realization and a link is formed between the note and the corresponding location of the recording of the realization.

An alternative way to perform the mapping operation is to shift the two series of time intervals with respect to each other until a cross correlation function reaches a maximum value. Other mathematical methods for finding a best matching position between the two series can be utilized.

DETAILED DESCRIPTION

Figure 1:
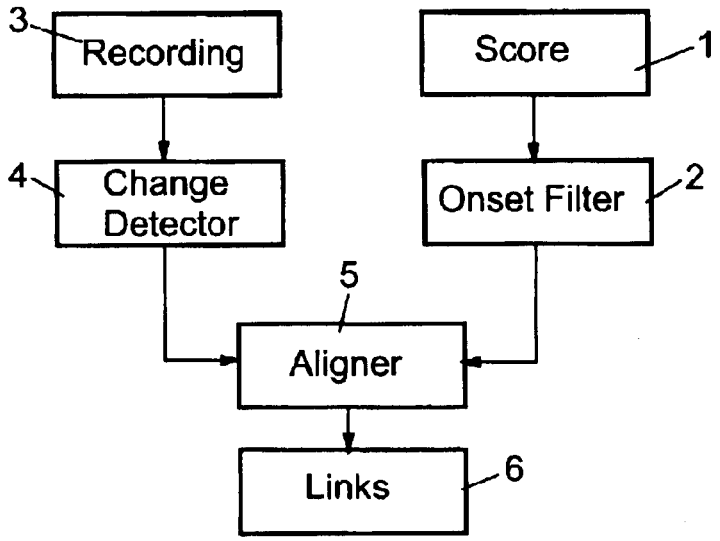
FIG. 1 is illustrative of a preferred embodiment of a method of the invention.

FIG. 1 is an overview diagram of a method to create links between the notes of a digital score and a realization of the score. In step 1 a digital score is inputted. In step 2 the digital score is filtered in order to determine significant onsets of the music. This can be done by accumulating the note-onset times across all voices and by clipping the resulting time-series to exclude non-significant note-onsets that are likely to be masked in a recording. This way the digital score is transformed into a series of time intervals with significant note-onsets.

On the other hand an analogue or digital recording of a realization of the music which is represented by the score is inputted in step 3. In step 4 the recording is analyzed by a changed detector. The purpose of the change detector is to identify time intervals within the recording with a significant change of the audio signal.

In one embodiment the change detector works in the time-domain of the audio signal. In a preferred implementation the change detector is based on the integrated intensity of the recorded audio signal. When the signal surpasses a predefined threshold level the corresponding signal peak is defined to be an onset. This way a series of time intervals having significant onsets is created.

In an alternative embodiment of the invention the change detector works in the frequency domain. This will be explained in greater detail with respect to FIG. 5.

In step 5 the series of time intervals determined in steps 2 and 4 are aligned with respect to each other in order to determine corresponding onsets within the recorded audio signal and the digital score. Pairs of corresponding onset events in the two series of time intervals are interrelated by means of links in step 6. Preferably the links are stored in a separate link-file.

Figure 2:
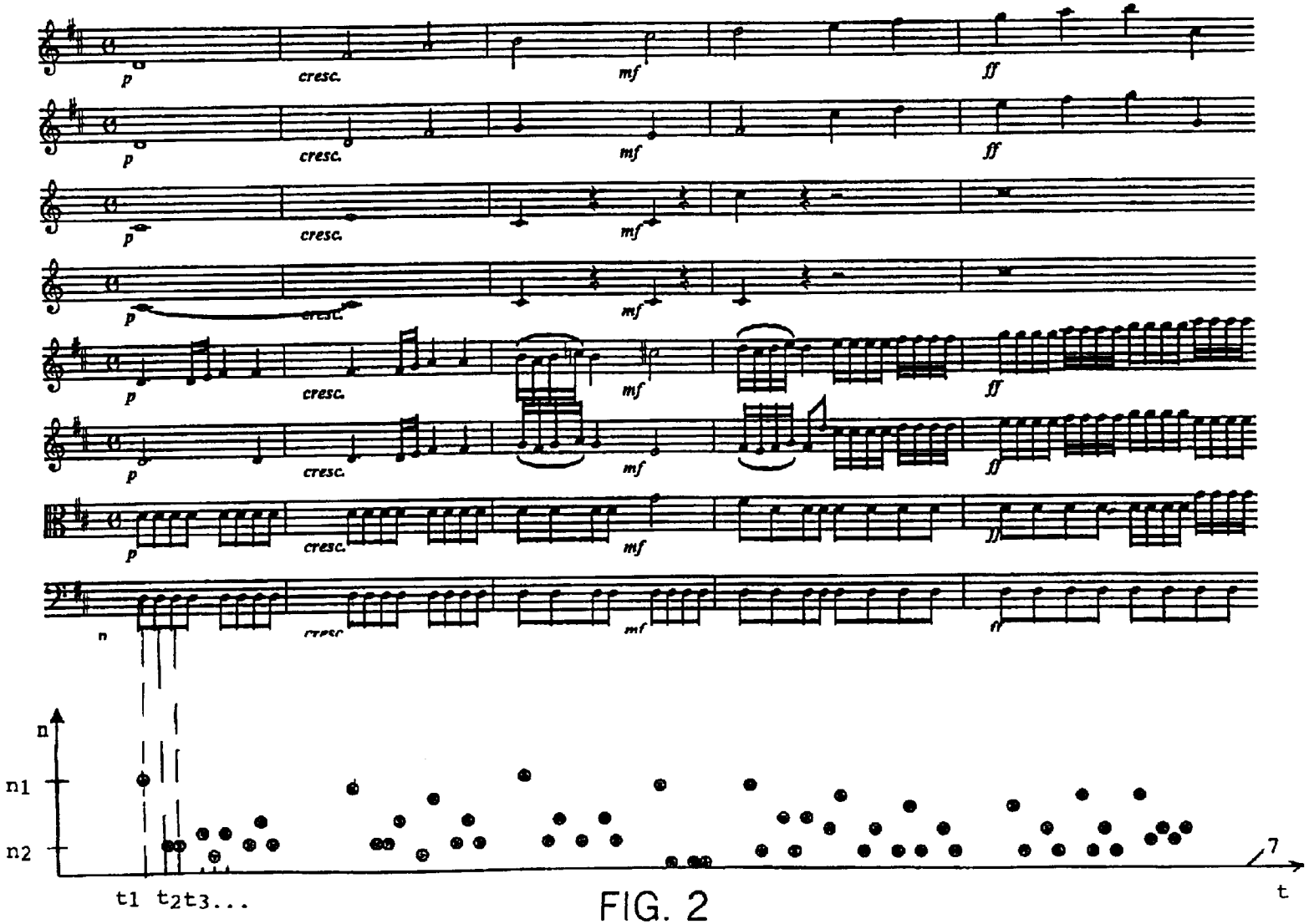
FIG. 2 illustrates by way of example how an onset curve is determined for a digital score.

FIG. 2 shows an example of a digital score (Josef Haydn, Symphony Hoboken I:1). The digital score can be stored in the form of a MIDI file or a similar digital score format. The digital score is displayed on a computer screen with a graphical user interface such that a user can select individual notes of the digital score by clicking on a computer mouse.

Below the digital score there is a time axis 7 having a discrete time scale. The time axis 7 is separated into time intervals. Preferably the scale of the time axis 7 is selected such that all notes of the score can be expressed as integer multiples of such a time interval.

To transform this discrete time axis into a millisecond time axis, this interval is scaled by equating the sum of the time intervals from the score with the duration of the realization of the score. In the preferred case the aforementioned time intervals are transformed into time points. In the example considered here this time interval is a sixteenth note.

For each multiple of this time interval the number of notes starting at this time is counted and accumulated leading to an onset curve as illustrated in the example of FIG. 2. At a time $t_1$ the accumulated number of notes starting at this time is $n_1=8$. In the consecutive time interval $t_2$ the accumulated note onsets is $n_2=2$ as well as in the following time interval $t_3$.

This way the whole digital score is scanned in order to determine the number of notes of the score starting within each of the time intervals of the time axis 7. This results in an onset curve which is represented by the points depicted in the diagram of FIG. 2.

Figure 3:
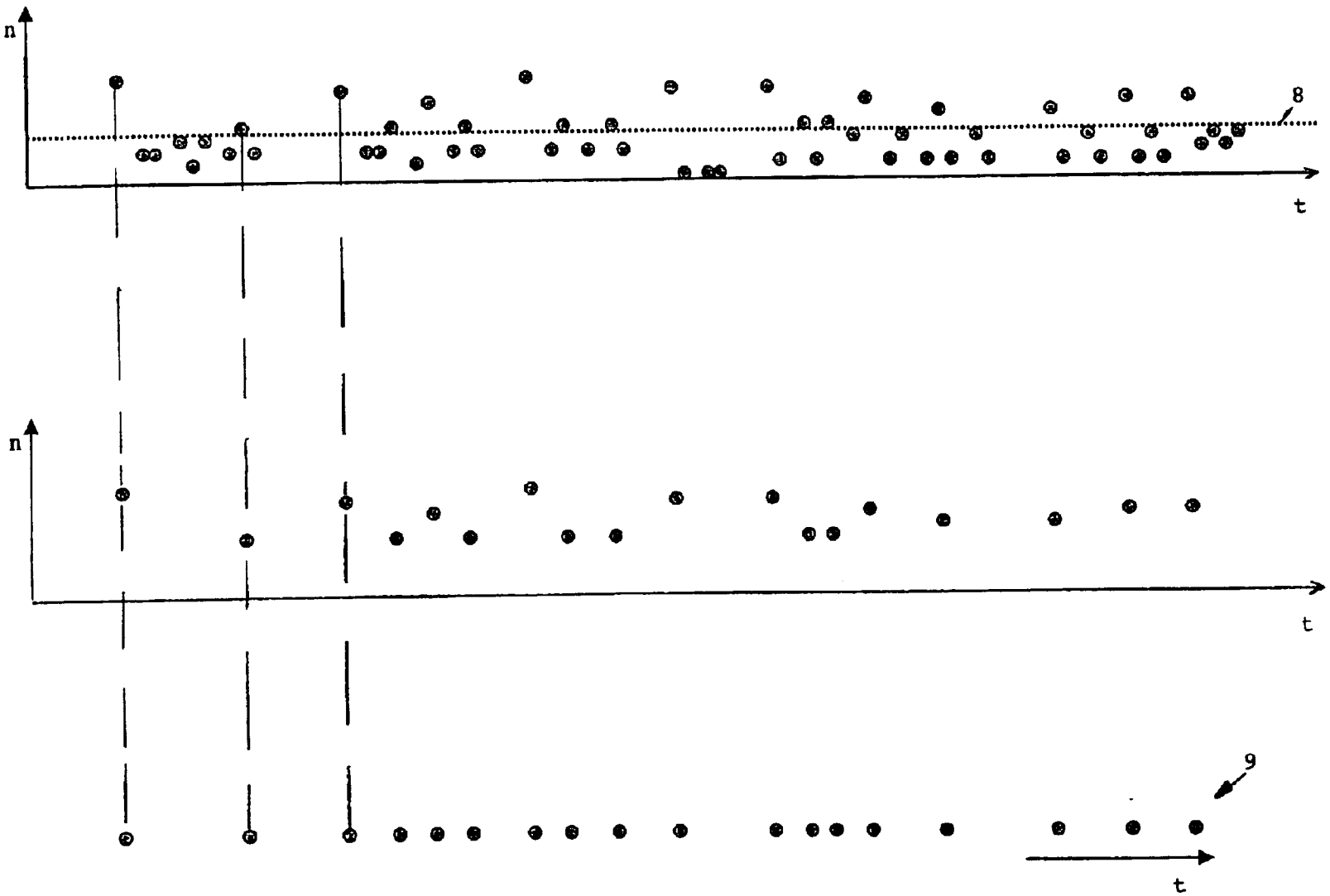
FIG. 3 illustrates the thresholding of the onset curve and the determination of a corresponding series of time intervals.

FIG. 3 illustrates the further processing of the onset curve. The accumulated onset values n are compared against a threshold 8. All accumulated onset values n which are below the threshold 8 are discarded. The remaining points of the curve determine the time intervals which constitute the series of significant onsets times 9.

Figure 4:
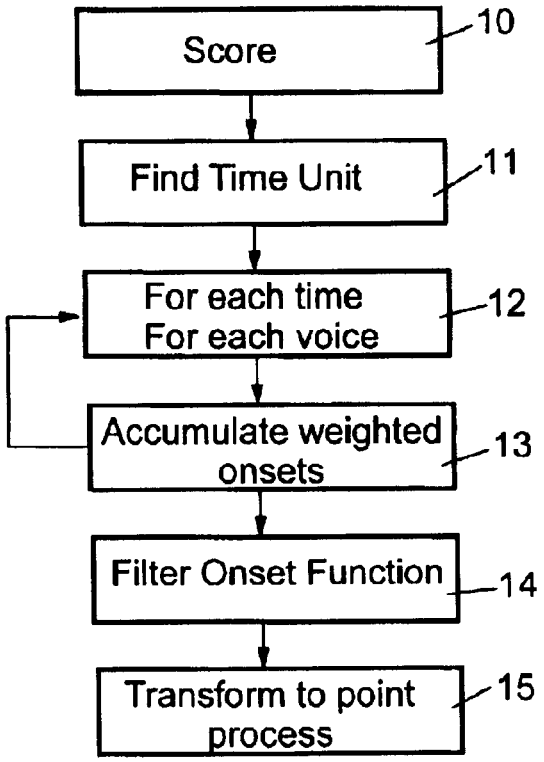
FIG. 4 is illustrative of a preferred embodiment for determining the series of time intervals for the representation of the digital score.

FIG. 4 shows a corresponding flow diagram.

In step 10 a digital score is inputted. In step 11 an appropriate time unit for the time axis is automatically selected such that all notes of the score can be expressed as integer multiples of this time unit. This way the time axis is separated into time intervals.

In steps 12 and 13 the onsets for each time interval are determined by accumulating the onsets within a given time interval for all voices. Preferably the onsets are weighted for the accumulation process by the respective dynamic values to favor those notes played in forte.

In step 14 a filter function is applied in order to filter out insignificant onset events in the digital score which are likely to be masked in the recording.

In step 15 the filtered onset curve is transformed into a point process, i.e. a series of time intervals being representative of significant audio events within the score.

Figure 5:
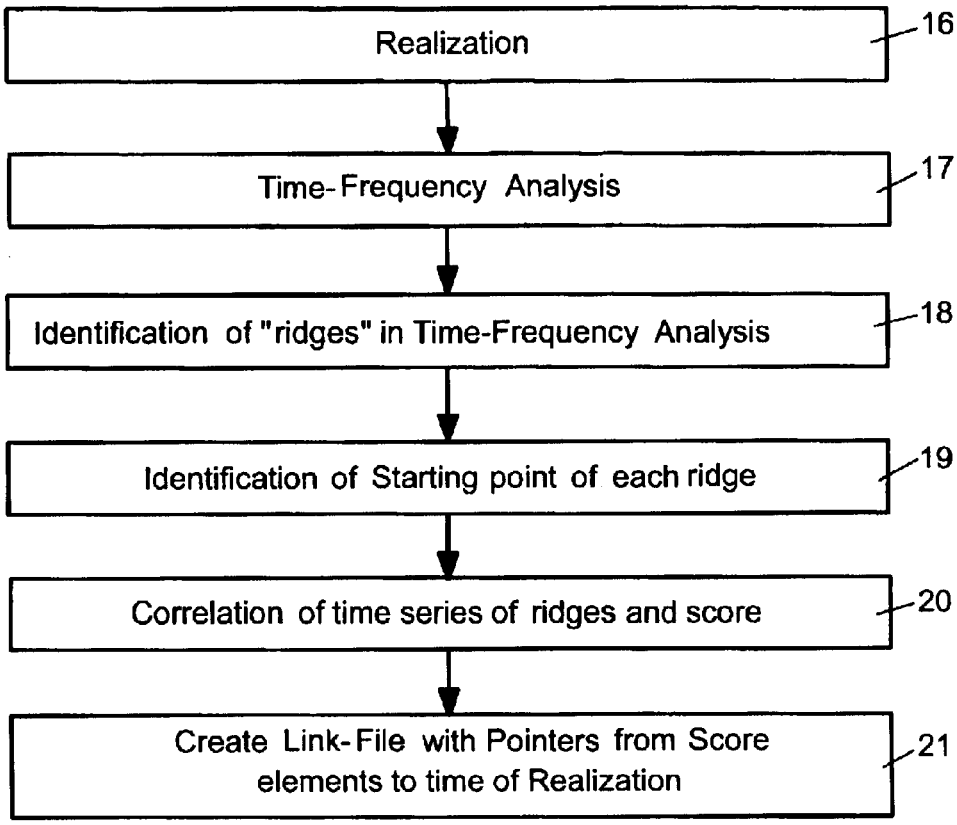
FIG. 5 is illustrative of a preferred embodiment for determining the time series for the realization of the score.

FIG. 5 illustrates an embodiment of the change detector (cf. step 4 of FIG. 1) in the frequency domain.

In step 16 a realization of the digital score is inputted. In step 17 a time frequency analysis is performed. Preferably this is done by means of a short time fast fourier transformation (FFT). This way a frequency spectrum is obtained for each of the time intervals of the time axis (cf. time axis 7 of FIG. 2).

In step 18 "ridges" or "crest lines" of the three-dimensional data provided by the time-frequency analysis are identified. One way of identifying such "ridges" is by performing a three dimensional watershed transform on the data provided by the time-frequency analysis as it is as such known from the prior art (U.S. Pat. No. 5,463,698) or a crazy climber algorithms to the time-frequency distribution [Rene Carmona et al, Practical Time-Frequency Analysis, Academic Press New York 1988].

In step 19 the starting point of each of the ridges is identified. Each starting point belongs to one of the time intervals. This way a series of time intervals is determined. This can be filtered as described for the onset curve of the realization.

In step 20 the time series of the intervals of the realization and of the score are correlated as explained above. In step 21 a link file is created with pointers from notes of a score to locations within the recorded realization of the music.

Figure 6:
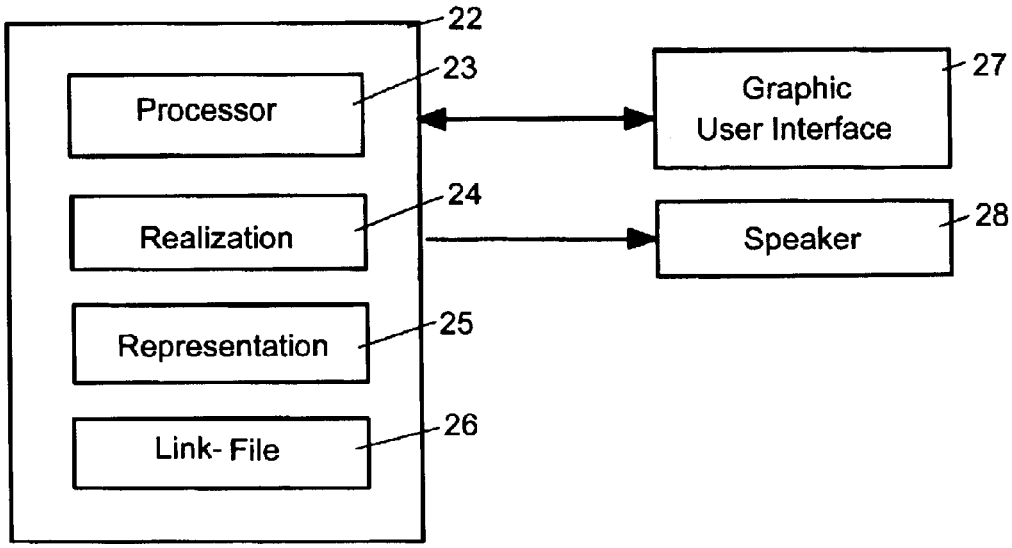
FIG. 6 is a block diagram of a preferred embodiment of an electronic device.

FIG. 6 shows a block diagram of an electronic device 22. The electronic device can be a personal computer with multimedia capabilities, a CD or DVD player or another audio device. The device 22 has a processor 23 and has storage means for storing a realization 24, a representation 25 and a link-file 26.

Further the electronic device 22 has a graphic user interface 27 and a speaker 28 for audio output. The processor 23 serves to render the representation 25 in the form of a score to be displayed on the graphical user interface 27. Further the processor 23 serves to playback the realization 24 of the score.

In operation the user can select a note of the score via the graphical user interface 27. In response the processor 23 performs an access to the link file 26 in order to read the link associated to the user selected note. This link provides an access point to the realization 24 which allows to start a playback of the realization 24 at a location identified by the link. The playback is outputted via speaker 28.

| LIST OF REFERENCE NUMERALS | |
|---|---|
| time axis | 7 |
| threshold | 8 |
| series | 9 |
| electronic device | 22 |
| processor | 23 |
| realization | 24 |
| representation | 25 |
| link-file | 26 |
| user interface | 27 |
| speaker | 28 |

What is claimed is:

1. A method of generating a link between a note of a digital score and a realization of the score, the method comprising the steps of:

generating, using a digital score, first data being descriptive of an onset curve by determining numbers of notes of the score starting at consecutive time intervals;

filtering the onset curve, the filtered onset curve being descriptive of a first series of first time intervals, each first time interval having a significant number of onsets;

generating, using a realization of the digital score, a second series of second time intervals, each second time interval having a significant dynamic change of the realization; and correlating the first and the second series of time intervals.

2. The method of claim 1 further comprising selecting a discrete time axis with discrete time intervals much that all onsets of the notes of the digital score can be expressed as integer multiples of the discrete time interval.

3. The method of claim 1, wherein the filtering of the onset curve comprises a step of comparing the first data with a threshold value.

4. The method of claim 3, wherein the second series is generated by determining second time intervals within which the intensity of the realization increases above the threshold value.

5. The method of claim 1, wherein generating the second series of second time intervals further comprises the steps of:

performing a time-frequency analysis of the realization;

identifying one or more ridges in a time-frequency domain;

identifying a starting point for each of the ridges; and determining the second time interval for each of the starting points.

6. The method of claim 1, wherein the mapping is performed by minimizing a Hausdorff distance of the first and second series.

7. The method of claim 1, wherein the mapping is performed by maximizing a cross correlation coefficient of the first and second series.

8. The method of claim 1, wherein the first data is descriptive of an endpoint of each note.

9. The method of claim 5, wherein an endpoint of each ridge is used as the starting point.

10. An information handling system for generating a link between a note of a digital score and a realization of the score, comprising:

means, using a digital score, for generating first data being descriptive of an onset curve by determining numbers of notes of the score starting at consecutive time intervals;

means for filtering the onset curve, the filtered onset curve being descriptive or a first series of first time intervals, each of the first time intervals having a significant number of onsets;

means, using a realization of the digital score, for generating a second series of second time intervals, each second time interval having a significant dynamic change of the realization; and means for correlating the first and the second series of time intervals.

11. The information handling system of claim 10 further comprising means for selecting a discrete time axis with discrete time intervals such that all onsets of the notes of the digital score can be expressed as integer multiples of the discrete time interval.

12. The information handling system of claim 10, wherein the means for filtering the onset curve comprises means for comparing the first data with a threshold value.

13. The information handling system of claim 12, wherein the means for generating the second series includes means for determining second time intervals within which the intensity of the realization increases above the threshold value.

14. The information handling system of claim 10, wherein the means for generating the second series of second time intervals further comprises:

means for performing a time-frequency analysis of the realization;

means for identifying one or more ridges in a time-frequency domain;

means for identifying a starting point for each of the ridges; and means for determining the second time interval for each of the starting points.

15. The information handling system of claim 14, wherein an endpoint of each ridge is used as the starting point.

16. The information handling system of claim 10, wherein the means for mapping is performed by minimizing a Hausdorff distance of the first and second series.

17. The information handling system of claim 10, wherein the means for mapping is performed by maximizing a cross correlation coefficient of the first and second series.

18. The information handling system of claim 10, wherein the first data is descriptive of an endpoint of each note.

19. A computer program product stored in a computer operable media for generating a link between a note of a digital score and a realization of the score, said program product comprising:

means, using a digital score, for generating first data being descriptive of an onset curve by determining numbers of notes of the score starting at consecutive time intervals;

means for filtering the onset curve, the filtered onset curve being descriptive of a first series of first time intervals, each of the first time intervals having a significant number of onsets;

means, using a realization of the digital score, for generating a second series of second time intervals, each second time interval having a significant dynamic change of the realization; and means for correlating the first and the second series of time intervals.

20. The computer program product of claim 19 further comprising means for selecting a discrete time axis with discrete time intervals such that all onsets of the notes of the digital score can be expressed as integer multiples of the discrete time interval.

21. The computer program product of claim 19, wherein the means for filtering the onset curve comprises means for comparing the first data with a threshold value.

22. The computer program product of claim 21, wherein the means for generating the second series includes means for determining second time intervals within which the intensity of the realization increases above the threshold value.

23. The computer program product of claim 19, wherein the means for generating the second series of second time intervals further comprises:

means for performing a time-frequency analysis of the realization;

means for identifying one or more ridges in a time-frequency domain;

means for identifying a starting point for each of the ridges; and means for determining the second time interval for each of the starting points.

24. The computer program product of claim 23, wherein an endpoint of each ridge is used as the starting point.

25. The computer program product of claim 19, wherein the means for mapping is performed by minimizing a Hausdorff distance of the first and second series.

26. Thin computer program product of claim 19, the means for mapping is performed by maximizing a cross correlation coefficient of the first and second series.

27. The computer program product of claim 19, wherein the first data is descriptive of an endpoint of each note.

* * * * *

UNITED STATES PATENT AND TRADEMARK OFFICE

CERTIFICATE OF CORRECTION

PATENT NO. : 6,768,046 B2
DATED : July 27, 2004
INVENTOR(S) : Werner Kriechbaum and Gerhard Stenzel It is certified that error appears in the above-identified patent and that said Letters Patent is hereby corrected as shown below:

Column 8,
Line 7, please replace “much” with -- such --.

Signed and Sealed this

Fifteenth Day of February, 2005

JON W. DUDAS
*Director of the United States Patent and Trademark Office*